US009651315B2

(12) United States Patent
Cui et al.

(10) Patent No.: US 9,651,315 B2
(45) Date of Patent: May 16, 2017

(54) FIN OF HEAT EXCHANGER AND HEAT EXCHANGER

(71) Applicant: Hangzhou Sanhua Research Institute Co., Ltd., Hangzhou, Zhejiang (CN)

(72) Inventors: Kai Cui, Hangzhou (CN); Linjie Huang, Hangzhou (CN); Xiaodong Zhou, Hangzhou (CN); Xiaoyang Xu, Hangzhou (CN); Zhou Lv, Hangzhou (CN)

(73) Assignee: Hangzhou Sanhua Research Institute Co., Ltd., Hangzhou, Zhejiang (CN)

( * ) Notice: Subject to any disclaimer, the term of this patent is extended or adjusted under 35 U.S.C. 154(b) by 121 days.

(21) Appl. No.: 14/428,955

(22) PCT Filed: Sep. 3, 2013

(86) PCT No.: PCT/CN2013/082840

§ 371 (c)(1),
(2) Date: Mar. 17, 2015

(87) PCT Pub. No.: WO2014/048228

PCT Pub. Date: Apr. 3, 2014

(65) Prior Publication Data

US 2015/0226496 A1 Aug. 13, 2015

(30) Foreign Application Priority Data

Sep. 26, 2012 (CN) ..... 2012 1 0364693
Nov. 26, 2012 (CN) ..... 2012 1 0484380

(51) Int. Cl.
*F28F 13/12* (2006.01)
*F28F 3/02* (2006.01)
*F28D 9/00* (2006.01)

(52) U.S. Cl.
CPC ..... *F28F 3/027* (2013.01); *F28D 9/005* (2013.01); *F28D 9/0062* (2013.01); *F28F 13/125* (2013.01); *F28F 2215/08* (2013.01)

(58) Field of Classification Search
CPC .. F28F 1/128; F28F 3/027; F28F 13/12; F28F 13/125
(Continued)

(56) References Cited

U.S. PATENT DOCUMENTS 3,262,495 A * 7/1966 Baird ..... F28D 1/0316 165/152
4,815,532 A * 3/1989 Sasaki ..... F28D 1/0333 165/152
(Continued)

FOREIGN PATENT DOCUMENTS

CN 1233730 A 11/1999
CN 201433802 Y 3/2010
(Continued)

OTHER PUBLICATIONS

International Search Report dated Dec. 12, 2013 from corresponding International Application No. PCT/CN2013/082840.

*Primary Examiner* — Allen Flanigan
(74) *Attorney, Agent, or Firm* — Wolf, Greenfield & Sacks, P.C.

(57) ABSTRACT

A heat exchanger and fins thereof are provided. The fin includes a plurality of first fin units and a plurality of second fin units which are arranged in parallel and alternately, and each first fin unit includes a first louver facing an inflow direction of fluid, and each second fin unit includes a second louver facing the inflow direction of the fluid, the first louver and the second louver are arranged in parallel, and the first louver and the second louver are staggered in the inflow direction of the fluid to form a first space between the first louver and the second louver, and at least one of first louvers or at least one of second louvers has a varied width.

19 Claims, 11 Drawing Sheets

(58) Field of Classification Search
USPC ..... 165/109.1, 152
See application file for complete search history.

(56) References Cited

U.S. PATENT DOCUMENTS

| | | | | |
|---|---|---|---|---|
| 6,273,183 | B1 * | 8/2001 | So | F28F 13/12 165/109.1 |
| 6,415,855 | B2 * | 7/2002 | Gerard | F25J 5/002 165/146 |
| 6,675,878 | B2 * | 1/2004 | Haasch | F28D 9/0012 165/109.1 |
| 6,729,388 | B2 * | 5/2004 | Emrich | F02B 29/0456 165/109.1 |
| 6,820,682 | B2 * | 11/2004 | Hayashi | B60H 1/025 165/109.1 |
| 7,191,824 | B2 * | 3/2007 | Wu | F02B 29/0462 165/141 |
| 2003/0131973 | A1 | 7/2003 | Nair et al. | |
| 2008/0264616 | A1 * | 10/2008 | Deschodt | F28D 9/0068 165/152 |
| 2011/0005725 | A1 * | 1/2011 | Hou | F28D 15/0233 165/104.26 |

FOREIGN PATENT DOCUMENTS

| | | | |
|---|---|---|---|
| CN | 102478368 | A | 5/2012 |
| DE | 243088 | A1 | 2/1987 |
| JP | H 09296989 | A | 11/1997 |
| JP | 2001194086 | A | 7/2001 |

* cited by examiner

FIN OF HEAT EXCHANGER AND HEAT EXCHANGER

This application is the national phase of International Application No. PCT/CN2013/082840, filed on Sep. 3, 2013, which claims the benefit of priorities to Chinese Patent Application No. 201210364693.3 titled "FIN OF HEAT EXCHANGER AND HEAT EXCHANGER", filed with the Chinese State Intellectual Property Office on Sep. 26, 2012, and Chinese Patent Application No. 201210484380.1 titled "FIN OF HEAT EXCHANGER AND HEAT EXCHANGER", filed with the Chinese State Intellectual Property Office on Nov. 26, 2012, which applications are incorporated herein by reference to the maximum extent allowable by law.

TECHNICAL FIELD

The present application relates to fins of a heat exchanger and the heat exchanger, and particularly to a fin which can generate strong fluid turbulence and a plate-fin heat exchanger having the fin.

BACKGROUND

A plate-fin heat exchanger generally includes baffles, fins, sealing strips, and deflectors. The fins, the deflectors and the sealing strips are arranged between two adjacent baffles to form a sandwich layer which is a channel. Multiple sandwich layers are overlapped in various manners according to the actual requirements and then are integrated as a whole by brazing, thereby forming a plate bundle. The plate bundle is further assembled with corresponding parts, such as a seal cap, a connecting pipe, a supporting member, to form the plate-fin heat exchanger.

The plate-fin heat exchanger is defined as a heat transmission component including circulating plates and fins. The fins are a key component, and common fins include straight fins, serrated fins, wavy fins, perforated fins and louvered fins. In order to enhance the heat exchange efficiency of the plate-fin heat exchanger, continuous developments and improvements have been made to the structure of the fins.

Compared with a conventional heat exchanger, the plate-fin heat exchanger has a reinforced heat exchange surface and a compact structure, and has a light weight since it is generally made of aluminum alloy. The disturbance on fluid caused by the fins continuously destroys the boundary layer of the fluid, and at the same time, the baffles and the fins both have a high heat conductivity, thus the plate-fin heat exchanger has a high efficiency. Therefore, the plate-fin heat exchanger is adaptable and can be used for heat exchange between various fluids and a phase-change heat exchange with state change. By arranging and combining passages, the plate-fin heat exchanger can adapt to various heat exchange conditions, such as a counter flow condition, a cross flow condition, a multi-flow condition, and a multilayer flow condition. The plate-fin heat exchanger can also meet the heat exchange requirement of the large scale equipment through the combination of series connection, parallel connection, and series and parallel connection of units. Currently, the plate-fin heat exchanger is widely used in air separation plant, petrochemical engineering, refrigeration and cryogenic field, automobile and aviation industries, and etc.

The plate-fin heat exchanger has a compact structure and a light weight, and has a limited installation space, thus there is little room for improvement and optimization of the flow channel structure. However, the structural design of fins of the plate-fin heat exchanger is flexible, and can be further improved and optimized. With the increasing of the heat dissipating capacity of the equipment, the heat exchange efficiency of the plate-fin heat exchanger is also required to be increased. Under this background, one of the main research trends is to improve and optimize the structure of fins of the plate-fin heat exchanger, so as to increase the heat exchange efficiency between the fins and high temperature or low temperature media that passes through the fins.

Reference is made to FIG. 1, which is a schematic view showing the structure of a conventional oil cooler. The conventional oil cooler includes multiple plates 1' and louvered fins 2' each of which is located between two adjacent plates 1'. The louvered fins 2' are configured to change the flow direction of the coolant or the heating medium, to destroy the boundary layer thereof to generate turbulence.

A partial structure of the louvered fin 2' is shown in FIG. 2. The louvered fin 2' includes multiple fin units 3'. Each fin unit 3' includes a top portion 4', a bottom portion 5' and two symmetrical louvers 6', 7'. Adjacent fin units 3' are arranged in parallel and staggered to each other, that is, a space 8' is formed between two adjacent parallel louvers. When flowing towards the louvers 6', 7' of the fin in the direction indicated by the arrow, the coolant or the heating medium will be blocked by the louvers 6', 7', thus will be continuously divided in the traverse plane. When the coolant or the heating medium is divided, the boundary layer thereof is destroyed by the louvered fin 2' continuously, which may generate turbulence on partial plane, and in turn enhances the heat exchange capability of the plate-fin heat exchanger to some extent. However, in the flow dividing process, due to the limitation of the shape of the louvers 6', 7' of the fin, the cooling or the heating medium mainly generates lateral turbulence, and generates little longitudinal (i.e., vertical) turbulence.

Thus, it is necessary to improve the conventional technology to solve the above technical problems.

SUMMARY

An object of the present application is to provide a fin with high heat exchange efficiency and a heat exchanger having the fin.

To realize the above object, the following technical solutions are provided according to the present application. A fin of a heat exchanger includes a plurality of first fin units and a plurality of second fin units which are arranged in parallel and alternately, and each first fin unit includes a first louver facing an inflow direction of fluid, and each second fin unit includes a second louver facing the inflow direction of the fluid, the first louver and the second louver are arranged in parallel, and the first louver and the second louver are staggered in the inflow direction of the fluid to form a first space between the first louver and the second louver, and at least one of first louvers or at least one of second louvers has a varied width.

As an improved technical solution of the present application, as viewed from the inflow direction of the fluid, a top end of the first louver is broader than a bottom end of the first louver, and a top end of the second louver is narrower than a bottom end of the second louver.

As an improved technical solution of the present application, the first louver and the second louver are parallel with each other, and both of the first louver and the second louver has a top half area and a bottom half area which are not equal, and the top half area of the first louver is greater than the bottom half area thereof, and the top half area of the second louver is smaller than the bottom half area thereof.

As an improved technical solution of the present application, the first louver is of a trapezoid shape, a triangular shape, a semicircular shape, or a stepped shape; and the second louver is of a trapezoid shape, a triangular shape, a semicircular shape, or a stepped shape.

As an improved technical solution of the present application, each of the first louver and the second louver has a continuously varied width.

As an improved technical solution of the present application, at least one of the first louver and the second louver is of a shape which is broader at two ends and narrower at the middle, or narrower at the two ends and broader at the middle.

As an improved technical solution of the present application, the first louver is of a shape which is broader at the middle and narrower at two ends, and the second louver is of a shape which is narrower at the middle and broader at two ends.

As an improved technical solution of the present application, the first louver is symmetrical along its horizontal center line, and the second louver is also symmetrical along its horizontal center line.

As an improved technical solution of the present application, the first louver is of a hexagon shape, the first louver and the second louver are each formed by punching one piece of metallic plate, and the first louver and the second louver adjacent to each other each have a complementary shape at the punched places.

As an improved technical solution of the present application, each of the first louver and the second louver has a discontinuously varied width.

As an improved technical solution of the present application, the first fin unit includes a first top portion extending horizontally from a top of the first louver and a first bottom portion extending horizontally from a bottom of the first louver, and the second louver unit includes a second top portion extending horizontally from a top of the second louver and a second bottom portion extending horizontally from a bottom of the second louver, and the first top portion and the second top portion abut with each other and are located at the same plane, and the first bottom portion and the second bottom portion abut with each other and are located at the same plane, and a length of the first top portion is different from a length of the second top portion in the inflow direction of the fluid, and a length of the first bottom portion is different from a length of the second bottom portion in the inflow direction of the fluid.

As an improved technical solution of the present application, the first fin unit includes a third louver obliquely extending downwardly from the first top portion, and the first louver and the third louver are symmetrical; the second fin unit includes a fourth louver obliquely extending downwardly from the second top portion, and the second louver and the fourth louver are symmetrical; and the third louver and the fourth louver are staggered in the inflow direction of the fluid to form a second space between the third louver and the fourth louver.

In order to realize the above object, a heat exchanger is also provided according to the present application. The heat exchanger includes a seat, a plurality of first circulating plates and a plurality of second circulating plates which are mounted on the seat and overlapped alternately, and a plurality of fins received in the first circulating plates and the second circulating plates, and the first circulating plate includes a first receiving space for receiving the corresponding fin, and the second circulating plate includes a second receiving space for receiving the corresponding fin; wherein, the fin is the above fin of the heat exchanger.

As an improved technical solution of the present application, each first circulating plate includes a first base and a first frame surrounding a periphery of the first base, the first receiving space is formed by the first base and the first frame, and the fin is fitted on the first base; each second circulating plate includes a second base and a second frame surrounding a periphery of the second base, the second receiving space is formed by the second base and the second frame, and the fin is fitted on the second base; and the first frame and the second frame are respectively provided with a protrusion and a groove which cooperate with each other.

As an improved technical solution of the present application, the first base is provided with a first flat hole and a first raised hole, and the corresponding fin is provided with first cutouts corresponding to the first flat hole and the first raised hole; and the second base is provided with a second flat hole and a second raised hole, and the corresponding fin is provided with second cutouts corresponding to the second flat hole and the second raised hole; and the fins are respectively level with the first raised hole and the second raised hole.

Compared with the conventional technology, at least one of the first louver and the second louver in the present application has a varied width, which will generate different resistances to the fluid, thereby generating a pressure difference in the vertical direction and further generating a better turbulence effect in the vertical direction.

DETAILED DESCRIPTION

Figure 1:
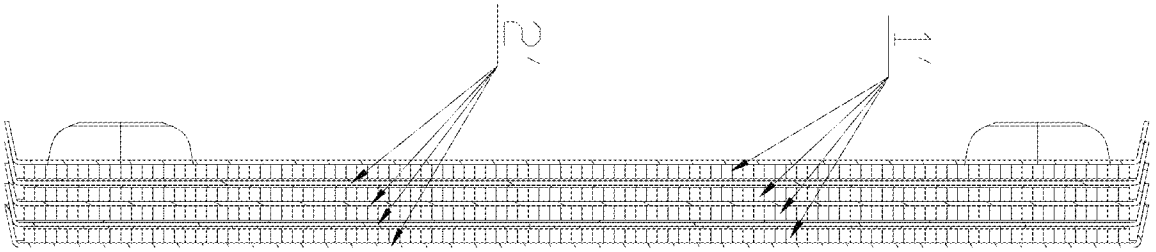
FIG. 1 is a side view of a conventional heat exchanger.
Figure 2:
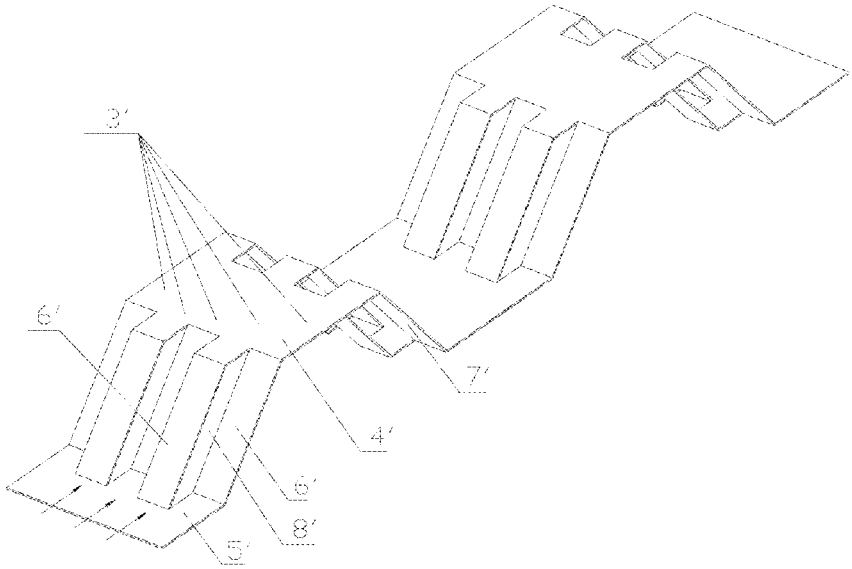
FIG. 2 is a perspective view of a fin of the conventional heat exchanger.

Reference is made to FIG. 3 to FIG. 10. A heat exchanger 100 is provided according to the present application, which includes a seat 1, multiple first circulating plates 2 and multiple second circulating plates 3 which are mounted on the seat 1 and are alternately overlapped, multiple fins 4 received in the first circulating plates 2 and the second circulating plates 3, and a top plate 7 mounted on top of the heat exchanger. In the embodiments shown in the Figures of the present application, the heat exchanger 100 is a plate-fin heat exchanger. To facilitate describing and understanding the technical solution of the present application, the overlapping direction of the first circulating plates 2 and the second circulating plates 3 is defined as a vertical direction or an up-down direction.

The seat 1 is provided with a mounting plate 11, and a periphery of the mounting plate 11 is protruding out of the first circulating plates 2 and the second circulating plates 3. The mounting plate 11 is provided with multiple mounting holes 12 allowing screws to pass through, to fix the heat exchanger 100.

The top plate 7 includes a top surface 71 of a flat plate shape and multiple cylindrical flanges protruding out of the top surface 71. The flanges include two first flanges 72 located on a diagonal and two second flanges 73 located on another diagonal. One of the two first flanges 72 acts as an inlet of a first fluid, and the other one acts as an outlet of the first fluid. One of the two second flanges 73 acts as an inlet of a second fluid, and the other one acts as an outlet of the second fluid. The first flanges 72 and the second flanges 73 are both provided for connection with pipes (not shown). In the following description, the first fluid and the second fluid are both referred to as fluid.

Figure 5:
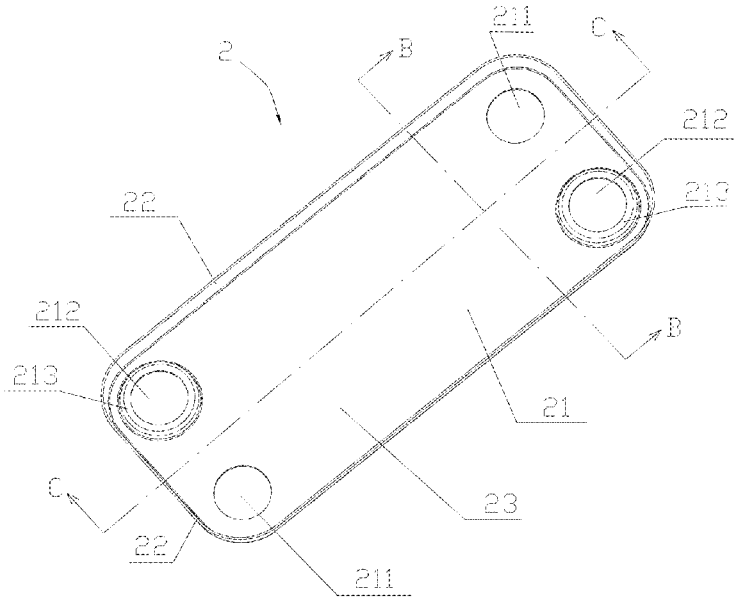
FIG. 5 is a perspective view of a first circulating plate in FIG. 4.
Figure 6:
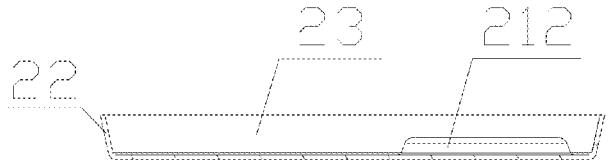
FIG. 6 is a sectional view taken along line B-B in FIG. 5.
Figure 7:
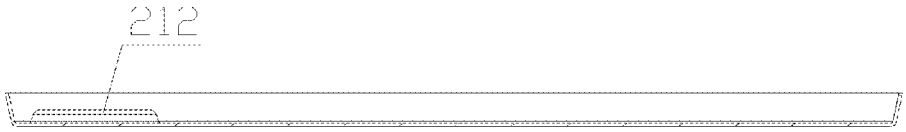
FIG. 7 is a sectional view taken along line C-C in FIG. 5.

Reference is made to FIG. 5. The first circulating plate 2 includes a first base 21 and a first frame 22 surrounding a periphery of the first base 21. The first frame 22 protrudes upward from the first base 21, and a first receiving space 23 is formed by the first frame 22 and the first base 21 to receive corresponding fins 4. The first base 21 is provided with multiple first flat holes 211 and multiple first raised holes 212. As shown in FIG. 6, each of the first raised holes 212 is formed by punching and includes a first protruding surface 213 at a top. In the embodiment shown in the Figures of the present application, two of the first flat holes 211 are located on one diagonal of the first base 21, and two of the first raised holes 212 are located on another diagonal of the first base 21. Certainly, in other embodiments, the first flat holes 211 may also be arranged at the same side and aligned with each other, and accordingly, the first raised holes 212 may be arranged at the other side and aligned with each other, that is, in FIG. 5, one of the first flat holes 211 changes position with one of the first raised holes 212.

Figure 8:
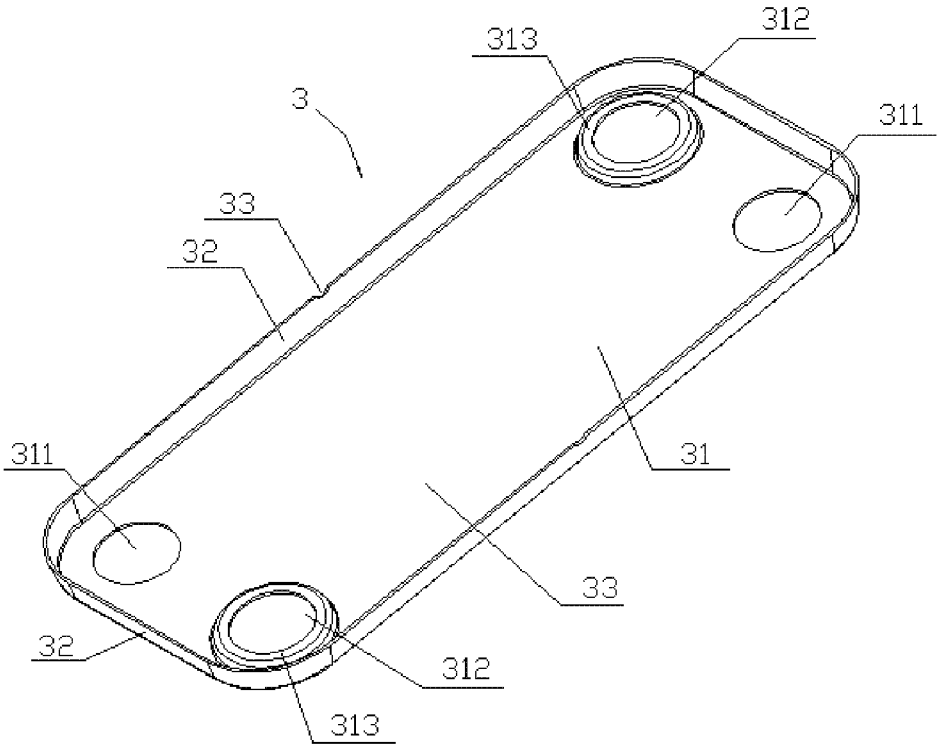
FIG. 8 is a perspective view of a second circulating plate in FIG. 4.

Reference is made to FIG. 8. The second circulating plate 3 includes a second base 31 and a second frame 32 surrounding a periphery of the first base 31. The second frame 32 protrudes upward from the second base 31, and a second receiving space 33 is formed by the second frame 32 and the second base 31 to receive corresponding fins 4. The second base 31 is provided with multiple second flat holes 311 and multiple second raised holes 312. Each of the second raised holes 312 is formed by punching and includes a second protruding surface 313 at a top. In the embodiment shown in the Figures of the present application, two of the second flat holes 311 are located on one diagonal of the second base 31, and two of the second raised holes 312 are located on another diagonal of the second base 31. Certainly, in other embodiments, the second flat holes 311 may also be arranged at the same side and aligned with each other, and accordingly, the second raised holes 312 may be arranged at the other side and aligned with each other, that is, in FIG. 8, one of the second flat holes 311 changes position with one of the second raised holes 312.

It is to be noted that, in the embodiments shown in the figures of the present application, the first flat holes 211 of the first circulating plate 2 are staggered with respect to the second flat holes 311 of the second circulating plate 3; the first raised holes 212 of the first circulating plate 2 are staggered with respect to the second raised holes 312 of the second circulating plate 3. The first flat holes 211 of the first circulating plate 2 are corresponding to the first flanges 72 respectively, and the second flat holes 311 of the second circulating plate 3 are corresponding to the second flanges 73 respectively.

Figure 3:
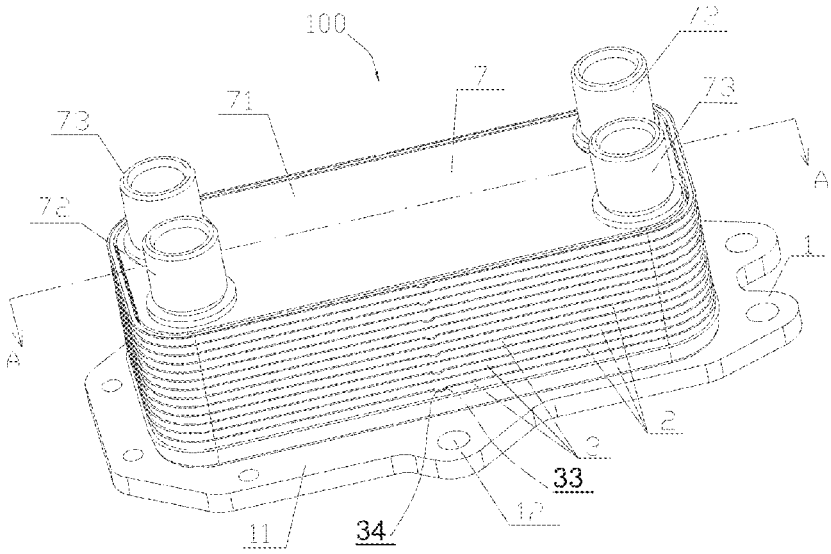
FIG. 3 is a perspective view of a heat exchanger according to the present application.
Figure 4:
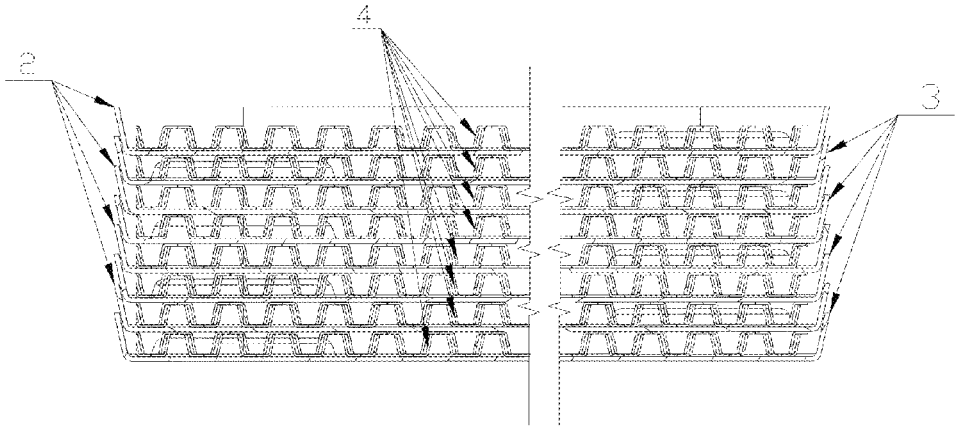
FIG. 4 is a sectional view of the heat exchanger according to the present application taken along line A-A in FIG. 3, in which a top plate and a seat are not shown.

Reference is made to FIG. 3. The first frame 22 of the first circulating plate 2 and the second frame 32 of the first circulating plate 3 are provided with a protrusion 33 and a groove 34, and the protrusion 33 and the groove 34 are configured to cooperate with each other. The cooperation between the protrusion 33 and the groove 33 can prevent an incorrect assembling, and once an incorrect assembling occurs, for example, two first circulating plates 2 are directly overlapped with each other by accident, a gap will be generated which is easy to be noticed. In the embodiments shown in the figures of the present application, the protrusion 33 is arranged on the first frame 22, and the groove 34 is arranged on the second frame 32. Certainly, in other embodiments, the protrusion 33 may also be arranged on the second frame 32, and the groove 34 may be arranged on the first frame 22, which may also prevent an incorrect assembling.

Reference is made to FIG. 5 and FIG. 8. Since the first circulating plate 2 has a structure similar to that of the second circulating plate 3, the first circulating plate 2 is taken as an example to describe the assembly relationship between the first circulating plate 2 and the corresponding fin 4.

Figure 9:
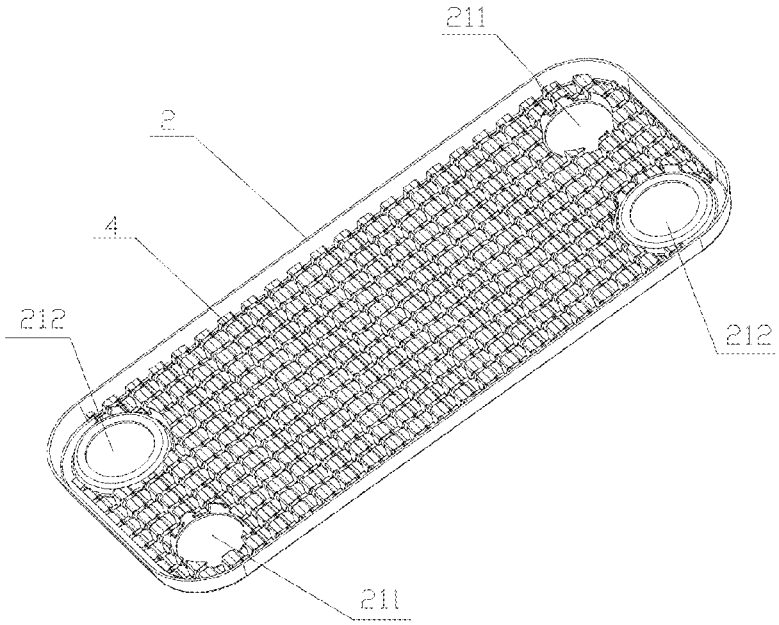
FIG. 9 is a perspective view of the first circulating plate in FIG. 4 being assembled with the fins according to a first embodiment.
Figure 10:
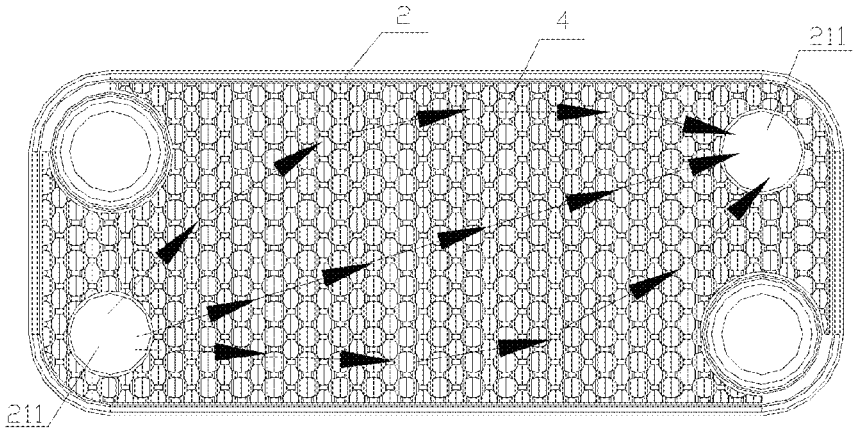
FIG. 10 is a top view of FIG. 9, which indicates an approximate flow direction of the fluid.
Figure 11:
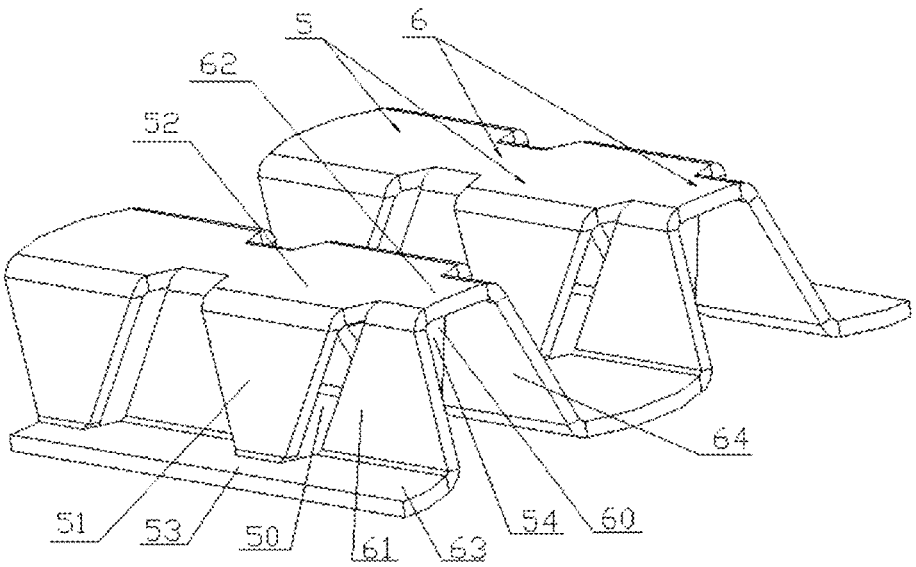
FIG. 11 is a perspective view of the fins in FIG. 9 in the first embodiment, in which a first fin unit and a second fin unit are arranged staggeredly and in parallel.
Figure 12:
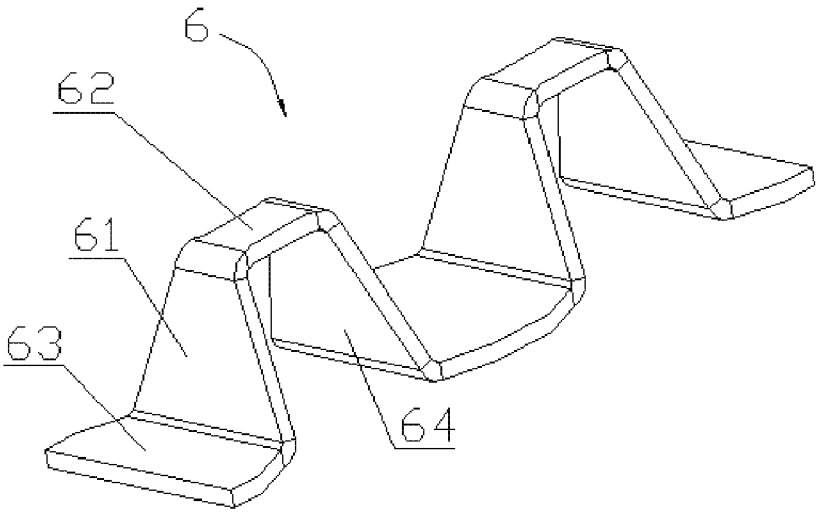
FIG. 12 is a perspective view of the second fin unit in FIG. 11.

Reference is made to FIG. 9 and FIG. 10. The fin 4 received in the first receiving space 23 is provided with multiple cutouts (not shown) corresponding to the first flat holes 211 and the first raised holes 212, and the fin 4 is level with the first protruding surfaces 213 of the first raised holes 212. It can be appreciated that, the fin 4 received in the second receiving space 33 is provided with multiple cutouts (not shown) corresponding to the second flat holes 311 and the second raised holes 312, and the fin 4 is level with the second protruding surfaces 313 of the second raised holes 312. The first protruding surfaces 213 and the second protruding surfaces 313 are respectively welded to parts abutting them (corresponding to the second plane surfaces 213 and the first flat holes 211 respectively), thereby ensuring that when flowing in the fins 4, the fluid will not flow into the first raised holes 212 or the second raised holes 312.

Reference is made to FIG. 10. The first flat hole 211 at the bottom left acts as an inlet, and the first flat hole 211 at the top right acts as an outlet. The arrows in FIG. 10 indicate a schematic path of the first fluid flowing from the inlet to the outlet.

Similarly, reference is made to FIG. 8. It can be appreciated that, the second fluid flows in via the second flat hole 311 at the top left and flows out via the second flat hole 311 at the bottom right.

The first fluid circulated in the circulating plate 2 and the second fluid circulated in the second circulating plate 3 in the present application are two different mediums, and the two different mediums are not mixed in the heat exchanger 100. The heat exchanger 100 of the present application is used for providing a place for the first fluid and the second fluid to exchange heat.

Reference is made to FIG. 11 to FIG. 15. The structure of the fin 4 is described in detail below. In the first embodiment shown in the figures of the present application, the fin 4 includes multiple first fin units 5 and multiple second fin units 6 arranged in parallel and alternately. Each first fin unit 5 includes a first louver 51 facing the inflow direction of the fluid (in the embodiment shown in the figures of the present application, the inflow direction is the fore-and-aft direction), a first top portion 52 extending horizontally from the top of the first louver 51, a first bottom portion 53 extending horizontally from the bottom of the first louver 51, and a third louver 54 obliquely extending downwardly from the first top portion 52. The first louver 51 and the third louver 54 are arranged symmetrically.

Similarly, each second fin unit 6 includes a second louver 61 facing the inflow direction of the fluid, a second top portion 62 extending horizontally from the top of the second louver 61, a second bottom portion 63 extending horizontally from the bottom of the second louver 61, and a fourth louver 64 obliquely extending downwardly from the second top portion 62. The second louver 61 and the fourth louver 64 are arranged symmetrically. In the embodiment shown in the figures of the present application, the first louver 51 and the second louver 61 are arranged in parallel in the left-to-right direction. The length of the first bottom portion 53 is smaller than the length of the second bottom portion 63 in the inflow direction of the fluid. The first louver 51 and the second louver 61 are staggered in the inflow direction of the fluid to form a first space 50 between the first louver 51 and the second louver 61. In the embodiment shown in the figures of the present application, the first louver 51 comes into contact with the fluid ahead of the second louver 61. In addition, the length of the first top portion 52 is greater than the length of the second top portion 62 in the inflow direction of the fluid. The third louver 54 and the fourth louver 64 are also staggered in the inflow direction of the fluid to form a second space 60 between the third louver 54 and the fourth louver 64. In the embodiment shown in the figures of the present application, the fourth louver 64 comes into contact with the fluid ahead of the third louver 54.

The first fin unit 5 and the second fin unit 6 are assembled with each other (for example, by welding) to form a whole, thereby improving the heat exchange performance. In particular, the first top portion 52 and the second top portion 62 abut with each other and are located in the same plane, and the first bottom portion 53 and the second bottom portion 63 abut with each other and are located in the same plane. In addition, the first bottom portion 53 and the second bottom portion 63 are both welded on the first base 21 of the first circulating plate 2 or the second base 31 of the second circulating plate 3.

In order to increase the turbulence in the vertical direction, in the heat exchanger 100 and the fins 4 of the present application, at least one of the first louver 51, the second louver 61, the third louver 54 and the fourth louver 64 is configured to have a top half area S1 and a bottom half area S2 which are not equal. The top half area S1 and the bottom half area S2 are divided by a center line (see the dashed line in FIG. 13), which is the same below.

In particular, in the embodiment shown in the figures of the present application, any one of the first louver 51 and the second louver 61 has a top half area S1 and a bottom half area S2 which are not equal. At the same time, any one of the third louver 54 and the fourth louver 64 has a top half area S1 and a bottom half area S2 which are not equal.

As viewed from the inflow direction of the fluid, the first louver 51 is of a trapezoid shape having a broader upper portion and a narrower lower portion, and the top half area S1 is greater than the bottom half area S2; and the second louver 61 is of a trapezoid shape having a narrower upper portion and a broader lower portion, and the top half area S1 is smaller than the bottom half area S2. The first louver 51 is parallel to the second louver 61. The first louver 51 being rotated by 180 degrees is totally same with the second louver 61, thereby simplifying the mould.

Figure 13:
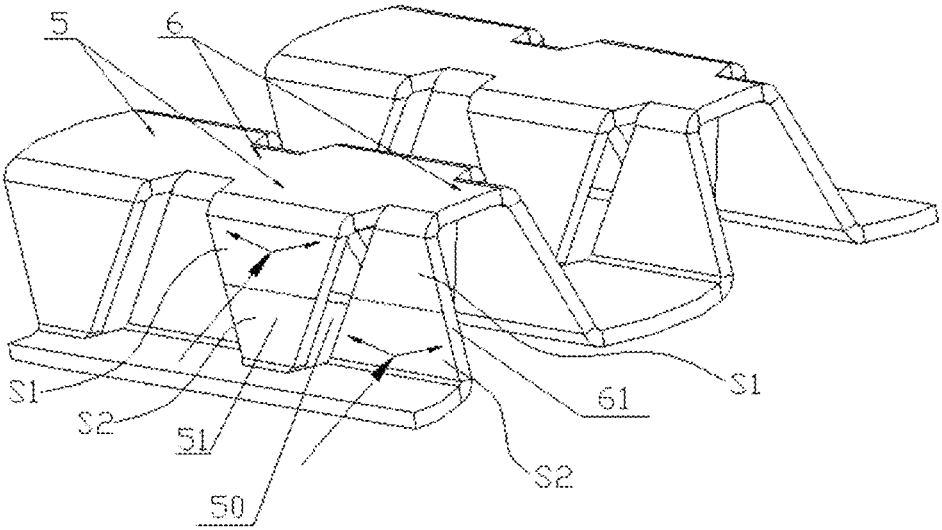
FIG. 13 is a perspective view of the fins in FIG. 11, which indicates a flow direction of the fluid.
Figure 14:
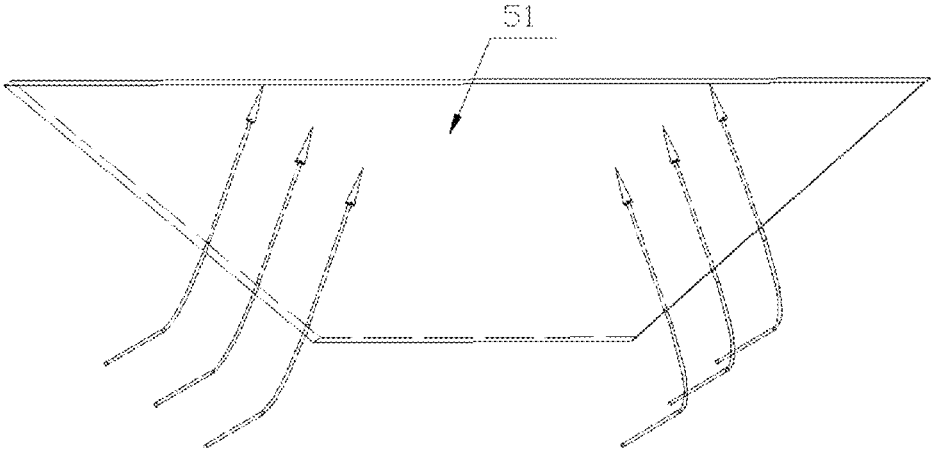
FIG. 14 is a schematic view showing the turbulence generated when fluid passing through first louvers of the first fin unit in FIG. 13.
Figure 15:
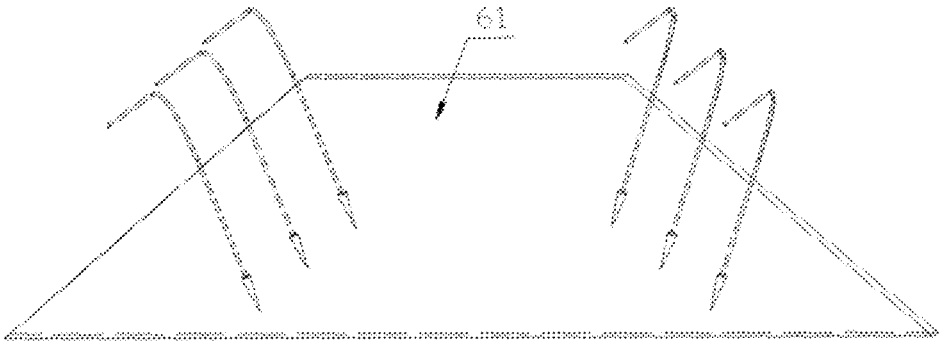
FIG. 15 is a schematic view showing the turbulence generated when fluid passing through second louvers of the second fin unit in FIG. 13.
Figure 16:
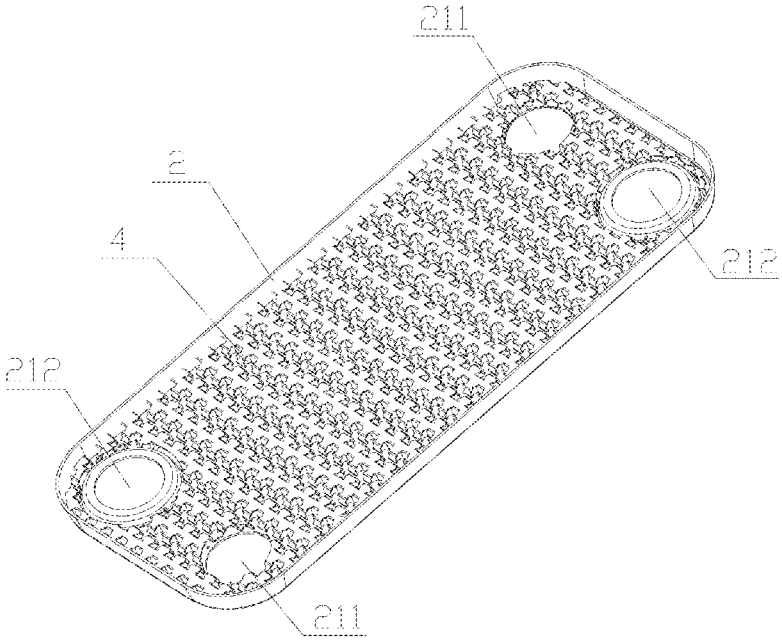
FIG. 16 is a perspective view of the first circulating plate in FIG. 4 being assembled with the fins according to a second embodiment.
Figure 17:
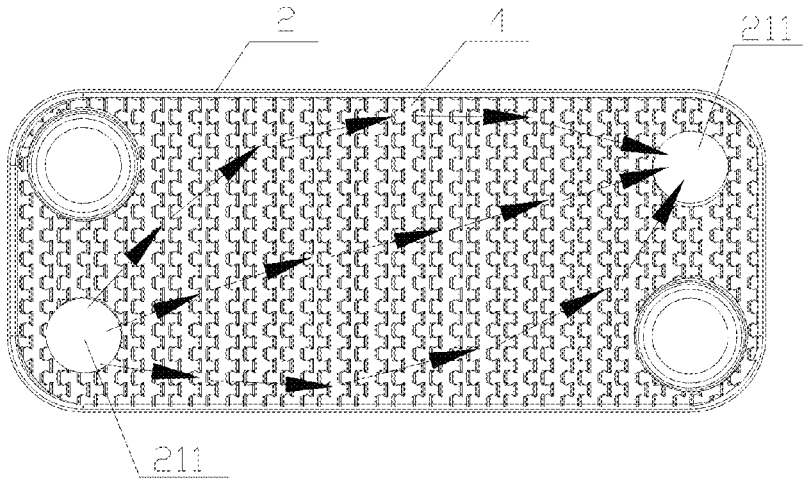
FIG. 17 is a top view of FIG. 16, which indicates an approximate flow direction of the fluid.

Reference is made to FIG. 13 to FIG. 15. The principle that the heat exchanger 100 and fins 4 thereof according to the present application can enhance the turbulence in the vertical direction is described in detail below.

Since the first louver 51 is closer to the fluid than the second window 61, the first louver 51 comes into contact with the fluid ahead of the second louver 61. When the fluid comes into contact with the first louver 51, the fluid is blocked by the first louver 51. Thus, on one hand, the fluid may be diffused transversely to two sides of the first louver 51, pass through the first space 50 and then continue to flow forward. In this process, since the first louver 51 has a varied width, the transverse distances of the fluid flowing to the two sides of the first louver 51 in the vertical direction are different, which increases the turbulence of the fluid in the vertical direction. On the other hand, since the top half area S1 of the first louver 51 is greater than the bottom half area S2 thereof, the fluid suffers a greater resistance on the top half of the first louver 51 than the bottom half of the first louver 51. Thus, the flow rate of the fluid at the top half of the first louver 51 is smaller than the flow rate of the fluid at the bottom half of the first louver 51. In other words, the space behind the top half of the first louver 51 is short of fluid. Referring to FIG. 14, in view of the flow rate of the fluid or the shortage of the fluid, the fluid at the bottom half of the first louver 51 may flow to the top half of the first louver 51 along the first space 50 due to the pressure difference, thereby generating a better turbulence from the bottom to the top.

After the fluid passes through the first louver 51, the remaining fluid may interact with the second louver 61. The remaining fluid at this time includes the part of diffused fluid that passes through the first louver 51. Similarly, the fluid is blocked by the second louver 61. On one hand, the fluid may be diffused transversely to the two sides of the second louver 61 and pass through the first space 50 and then continue to flow forward. On the other hand, since the top half area S1 of the second louver 61 is smaller than the bottom half area S2 thereof, the fluid suffers a smaller resistance on the top half of the second louver 62 than the bottom half of the second louver 62. Thus, the flow rate of the fluid at the top half of the second louver 61 is smaller than the flow rate of the fluid at the bottom half of the second louver 61. In other words, the space behind the bottom half of the second louver 61 is short of the fluid. In view of the flow rate of the fluid or the shortage of the fluid, the fluid at the top half of the second louver 61 may flow to the bottom half of the second louver 61 along the first space 50 due to the pressure difference, thereby generating a better turbulence from the top to the bottom.

The manner and effect of the fluid passing through the third louver 54 are same as the manner and effect of the fluid passing through the first louver 51, and the manner and effect of the fluid passing through the fourth louver 64 are same as the manner and effect of the fluid passing through the second louver 61.

It is to be noted that, although the first louver 51 and the second louver 61 in the embodiments shown in the figures of the present application are of a trapezoid shape, it can be appreciated that, other shapes may also be employed, as long as it has a varied width and/or having a top half area different from a bottom half area, such as a triangular shape, a semicircular shape or a stepped shape.

In addition, referring to FIG. 16 to FIG. 22, in the second embodiment shown in the figures of the present application, the fin 4 includes multiple first fin units 8 and multiple second fin units 9 arranged in parallel and alternately. Each first fin unit 8 includes a first louver 81 facing the inflow direction of the fluid (in the embodiment shown in the figures of the present application, the inflow direction is the fore-and-aft direction), a first top portion 82 extending horizontally from the top of the first louver 81, a first bottom portion 83 extending horizontally from the bottom of the first louver 81, and a third louver 84 obliquely extending downwardly from the first top portion 82. The first louver 81 and the third louver 84 are arranged symmetrically.

Similarly, each second fin unit 9 includes a second louver 91 facing the inflow direction of the fluid, a second top portion 92 extending horizontally from the top of the second louver 91, a second bottom portion 93 extending horizontally from the bottom of the second louver 91, and a fourth louver 94 obliquely extending downwardly from the second top portion 92. The second louver 91 and the fourth louver 94 are arranged symmetrically. In the embodiment shown in the figures of the present application, the first louver 81 and the second louver 91 are arranged in parallel in the left-to-right direction. The length of the first bottom portion 83 is smaller than the length of the second bottom portion 93 in the inflow direction of the fluid. The first louver 81 and the second louver 91 are staggered in the inflow direction of the fluid to form a first space 80 between the first louver 81 and the second louver 91. In the embodiment shown in the figures of the present application, the first louver 81 comes into contact with the fluid ahead of the second louver 91. The third louver 84 and the fourth louver 94 are also staggered in the inflow direction of the fluid to form a second space 90 between the third louver 84 and the fourth louver 94. In the embodiment shown in the figures of the present application, the third louver 84 comes into contact with the fluid ahead of the fourth louver 94.

The first fin unit 8 and the second fin unit 9 are assembled with each other to form a whole, thereby improving the heat exchange performance. In particular, the first top portion 82 and the second top portion 92 are abut with each other and are located in the same plane, and the first bottom portion 83 and the second bottom portion 93 abut with each other and are located in the same plane. In addition, the first bottom portion 83 and the second bottom portion 93 are both welded on the first base 21 of the first circulating plate 2 or the second base 31 of the second circulating plate 3.

Figure 18:
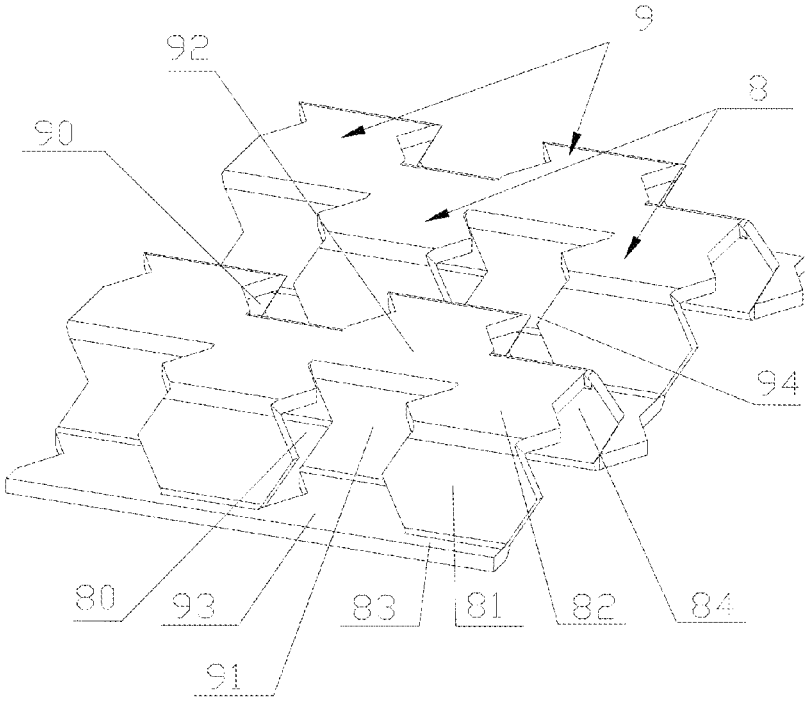
FIG. 18 is a perspective view of the fins in FIG. 16 in the second embodiment, in which a first fin unit and a second fin unit are arranged staggeredly and in parallel.
Figure 19:
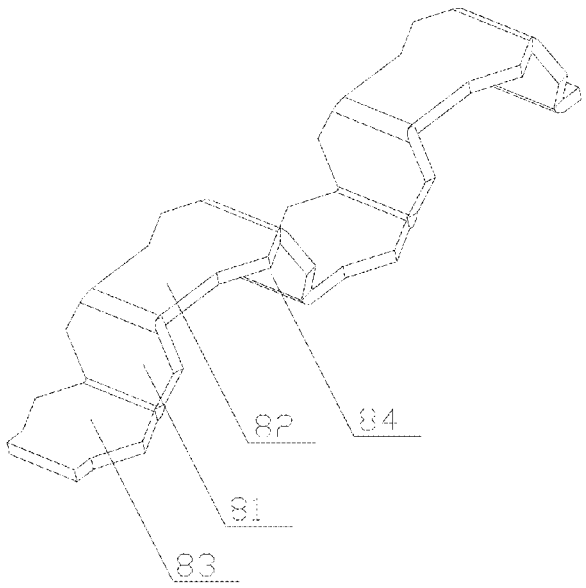
FIG. 19 is a perspective view of the first fin unit in FIG. 18.

Referring to FIG. 18, in the second embodiment shown in the figures of the present application, any one of the first louver 81, the second louver 91, the third louver 84 and the fourth louver 94 has a varied width, and the width changes discontinuously. Taking the first louver 81 as an example, the width of the first louver 81 is first increased and then decreased. In particular, in order to increase the turbulence in the vertical direction, in the heat exchanger 100 and the fins 4 thereof according to the present application, at least one of the first louver 81, the second louver 91, the third louver 84, and the fourth louver 94 is configured to have a shape which is broader at two ends and narrower at the middle, or is narrower at two ends and broader at the middle. In the embodiment shown in the figures of the present application, the first louver 81 and the third louver 84 are both of a shape which is narrower at two ends and broader at the middle, and the second louver 91 and the fourth louver 94 are both of a shape which is broader at two ends and narrower at the middle. Each of the first louver 81 and the third louver 84 is symmetrical along the respective horizontal center line (see the dashed lines in FIG. 20). Each of the second louver 91 and the fourth louver 94 is also symmetrical along the respective horizontal center line (see the dashed lines in FIG. 20). The first louver 81 and the second louver 91 are parallel with each other. The first louver 81 and the second louver 91 are inclined with respect to the inflow direction of the fluid, and the first louver 81 and the second louver 91 are staggeredly arranged in the inflow direction of the fluid. The third louver 84 and the fourth louver 94 are also parallel with each other. Referring to FIG. 21, the first louver 81 and the third louver 84 are of a hexagon shape.

Figure 20:
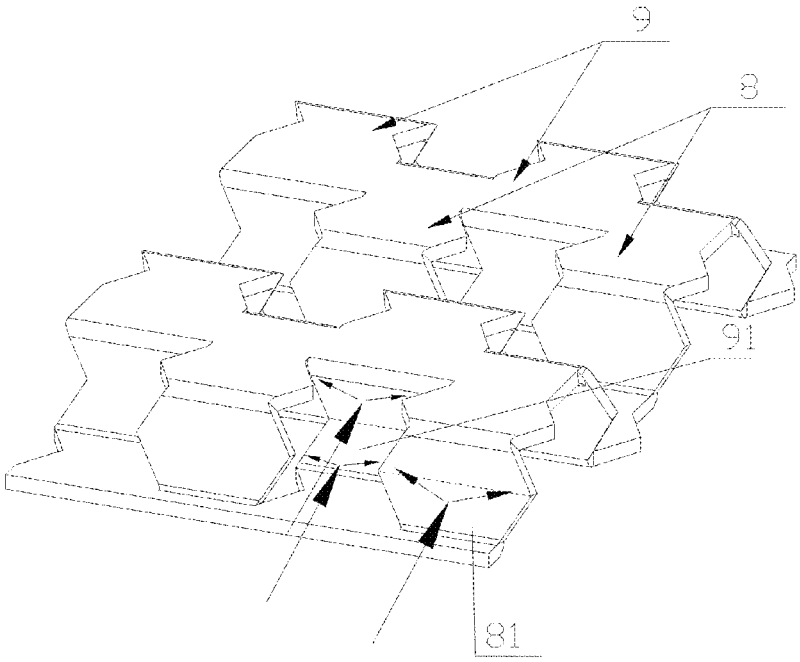
FIG. 20 is a perspective view of the fins in FIG. 18, which indicates a flow direction of the fluid.
Figure 21:
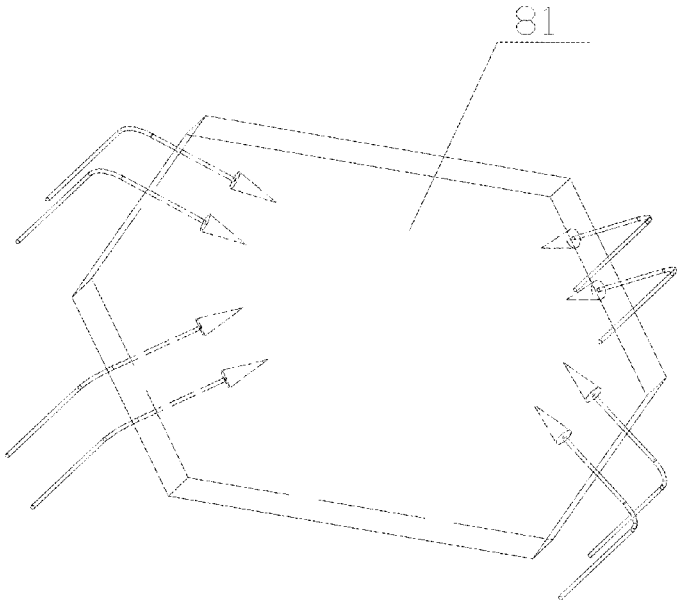
FIG. 21 is a schematic view showing the turbulence generated when fluid passing through first louvers of the first fin unit in FIG. 20.
Figure 22:
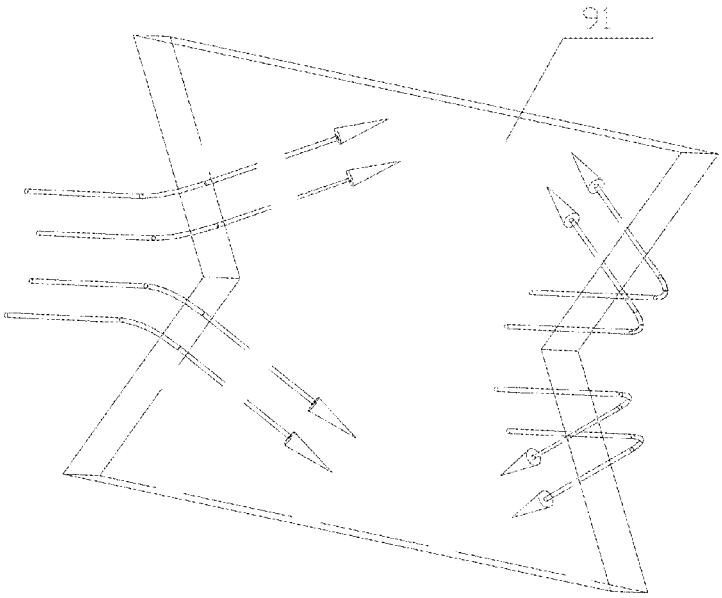
FIG. 22 is a schematic view showing the turbulence generated when fluid passing through second louvers of the second fin unit in FIG. 20.

Reference is made to FIG. 20 to FIG. 22. The principle that the heat exchanger 100 and the fins 4 thereof according to the present application can enhance the turbulence in the vertical direction is described in detail below.

Since the first louver 81 is closer to the fluid than the second louver 91, the first louver 81 comes into contact with the fluid ahead of the second louver 91. When the fluid comes into contact with the first louver 81, the fluid is blocked by the first louver 81. On one hand, the fluid may be diffused transversely to two sides of the first louver 81, pass through the first space 80 and then continue to flow forward. In this process, since the first louver 80 has a varied width, the transverse distances of the fluid flowing to the two sides of the first louver 80 in the vertical direction are different, which increases the turbulence of the fluid in the vertical direction. On the other hand, since the shape of the first louver 81 is broader at the middle and narrower at the two ends, the fluid suffers a greater resistance at the middle of the first louver 81 than the top end and the bottom end of the first louver 81. Thus, the flow rate of the fluid at the middle of the first louver 81 is smaller than the flow rate of the fluid at each of the top end and the bottom end of the first louver 81. In other words, the space behind the middle of the first louver 81 is short of fluid. Referring to FIG. 21, in view of the flow rate of the fluid or the shortage of the fluid, the fluid at the bottom portion and the top portion of the first louver 81 may flow to the middle of the first louver 81 along the first space 80 due to the pressure difference, thereby generating a better turbulence in the vertical direction.

After the fluid passes through the first louver 81, the remaining fluid may interact with the second louver 91. The remaining fluid at this time includes the part of diffused fluid that passes through the first louver 81. Similarly, the fluid is blocked by the second louver 91. On one hand, the fluid may be diffused transversely to the two sides of the second louver 91, pass through the first space 80 and then continue to flow forward. On the other hand, since the shape of the second louver 91 is narrower at the middle and broader at the two ends, the fluid suffers a greater resistance at each of the top end and the bottom end of the second louver 92 than the middle of the second louver 92. Thus, the flow rate of the fluid at each of the top end and the bottom end of the second louver 91 is smaller than the flow rate of the fluid at the middle of the second louver 91. In other words, the space behind the top end and the bottom end of the second louver 91 is short of fluid. Referring to FIG. 22, in view of the flow rate of the fluid or the shortage of the fluid, the fluid at the middle of the second louver 91 may flow to the top end and the bottom end of the second louver 91 along the first space 80 due to the pressure difference, thereby generating a better turbulence in the vertical direction.

The manner and effect of the fluid passing through the third louver 84 are same as the manner and effect of the fluid passing through the first louver 81, and the manner and effect of the fluid passing through the fourth louver 94 are same as the manner and effect of the fluid passing through the second louver 91.

It is to be noted that, although both of the first louver 81 and the third louver 84 in the embodiments shown in the figures of the present application are of a hexagon shape, it can be appreciated that, other shapes may also be employed, as long as it is narrower at the middle and broader at the two ends, such as a D shape, or a rhombus. Referring to FIG. 18 to FIG. 22, in the embodiments shown in the figures of the present application, the first louver 81 and the second louver 91 are each formed by punching one piece of metallic plate, and the first louver 81 and the second louver 91 adjacent to each other each have a complementary shape at the punched place respectively, and the complementary shapes thereof may be a triangular corner at one side of the first louver 81 and a corresponding triangular groove of the second louver 91. Such arrangement may facilitate the manufacture.

In conclusion, the heat exchanger 100 and the fins 4 thereof according to the present application can enhance the turbulence in the vertical direction while maintaining the turbulence in the transverse direction, and the turbulence in the vertical direction is variable (for example, being variable from the top to the bottom or from the bottom to the top), thus, a significant turbulence effect is generated. Due to the turbulence effect, the temperature of the fluid at various places of the heat exchanger 100 varies little, thereby improving the entire heat exchange efficiency of the heat exchanger 100.

It should be noted that the above embodiments are only intended for describing the present application, and should not be interpreted as limitation to the technical solutions of the present application. Although the present application is described in detail in conjunction with the above embodiments, it should be understood that, for those skilled in the art, modifications or equivalent substitutions may be made to the present application; and all of technical solutions and modifications thereof without departing from the principle and scope of the present application are deemed to fall into the scope of the present application defined by the claims.

The invention claimed is:

1. A fin of a heat exchanger, wherein the fin comprises a plurality of first fin units and a plurality of second fin units which are arranged in parallel and alternately, and each first fin unit comprises a first louver facing an inflow direction of fluid, and each second fin unit comprises a second louver facing the inflow direction of the fluid, the first louver and the second louver are arranged in parallel, and the first louver and the second louver are staggered in the inflow direction of the fluid to form a first space between the first louver and the second louver, and at least one of first louvers or at least one of second louvers has a varied width; and wherein the each first fin unit further comprises a first bottom portion extending horizontally from a bottom of the first louver, the each second fin unit further comprises a second top portion extending horizontally from a top of the second louver, and a length of the first bottom portion is different from a length of the second bottom portion in the inflow direction of the fluid.

2. The fin of the heat exchanger according to claim 1, wherein as viewed from the inflow direction of the fluid, a top end of the first louver is broader than a bottom end of the first louver, and a top end of the second louver is narrower than a bottom end of the second louver.

3. The fin of the heat exchanger according to claim 2, wherein the first louver and the second louver are parallel with each other, and both of the first louver and the second louver has a top half area and a bottom half area which are not equal, and the top half area of the first louver is greater than the bottom half area thereof, and the top half area of the second louver is smaller than the bottom half area thereof.

4. The fin of the heat exchanger according to claim 1, wherein the first louver is of a trapezoid shape, a triangular shape, a semicircular shape, or a stepped shape; and the second louver is of a trapezoid shape, a triangular shape, a semicircular shape, or a stepped shape.

5. The fin of the heat exchanger according to claim 1, wherein each of the first louver and the second louver has a continuously varied width.

6. The fin of the heat exchanger according to claim 1, wherein at least one of the first louver and the second louver is of a shape which is broader at two ends and narrower at the middle, or narrower at the two ends and broader at the middle.

7. The fin of the heat exchanger according to claim 6, wherein the first louver is of a shape which is broader at the middle and narrower at two ends, and the second louver is of a shape which is narrower at the middle and broader at two ends.

8. The fin of the heat exchanger according to claim 7, wherein the first louver is symmetrical along its horizontal center line, and the second louver is also symmetrical along its horizontal center line.

9. The fin of the heat exchanger according to claim 1, wherein each of the first louver and the second louver has a discontinuously varied width.

10. The fin of the heat exchanger according to claim 1, wherein the first fin unit comprises a first top portion extending horizontally from a top of the first louver and the first bottom portion, and the second louver unit comprises a second top portion extending horizontally from a top of the second louver and the second bottom portion extending horizontally from a bottom of the second louver, and the first top portion and the second top portion abut with each other and are located at the same plane, and the first bottom portion and the second bottom portion abut with each other and are located at the same plane, and a length of the first top portion is different from a length of the second top portion in the inflow direction of the fluid.

11. The fin of the heat exchanger according to claim 10, wherein the first fin unit comprises a third louver obliquely extending downwardly from the first top portion, and the first louver and the third louver are symmetrical; the second fin unit comprises a fourth louver obliquely extending downwardly from the second top portion, and the second louver and the fourth louver are symmetrical; and the third louver and the fourth louver are staggered in the inflow direction of the fluid to form a second space between the third louver and the fourth louver.

12. A heat exchanger, comprising a seat, a plurality of first circulating plates and a plurality of second circulating plates which are mounted on the seat and overlapped alternately, and a plurality of fins received in the first circulating plates and the second circulating plates, and the first circulating plate comprising a first receiving space for receiving the corresponding fin, and the second circulating plate comprising a second receiving space for receiving the corresponding fin, wherein, the fin is the fin according to claim 1.

13. The heat exchanger according to claim 12, wherein each first circulating plate comprises a first base and a first frame surrounding a periphery of the first base, the first receiving space is formed by the first base and the first frame, and the fin is fitted on the first base; each second circulating plate comprises a second base and a second frame surrounding a periphery of the second base, the second receiving space is formed by the second base and the second frame, and the fin is fitted on the second base; and the first frame and the second frame are respectively provided with a protrusion and a groove which cooperate with each other.

14. The heat exchanger according to claim 13, wherein the first base is provided with a first flat hole and a first raised hole, and the corresponding fin is provided with first cutouts corresponding to the first flat hole and the first raised hole; and the second base is provided with a second flat hole and a second raised hole, and the corresponding fin is provided with second cutouts corresponding to the second flat hole and the second raised hole; and the fins are respectively level with the first raised hole and the second raised hole.

15. The fin of the heat exchanger according to claim 1, wherein the first louver and the second louver are parallel with each other, and both of the first louver and the second louver has a top half area and a bottom half area which are not equal, and the top half area of the first louver is greater than the bottom half area thereof, and the top half area of the second louver is smaller than the bottom half area thereof.

16. The fin of the heat exchanger according to claim 2, wherein each of the first louver and the second louver has a continuously varied width.

17. The heat exchanger according to claim 12, wherein as viewed from the inflow direction of the fluid, a top end of the first louver is broader than a bottom end of the first louver, and a top end of the second louver is narrower than a bottom end of the second louver.

18. The heat exchanger according to claim 12, wherein the first fin unit comprises a first top portion extending horizontally from a top of the first louver and a first bottom portion extending horizontally from a bottom of the first louver, and the second louver unit comprises a second top portion extending horizontally from a top of the second louver and a second bottom portion extending horizontally from a bottom of the second louver, and the first top portion and the second top portion abut with each other and are located at the same plane, and the first bottom portion and the second bottom portion abut with each other and are located at the same plane, and a length of the first top portion is different from a length of the second top portion in the inflow direction of the fluid, and a length of the first bottom portion is different from a length of the second bottom portion in the inflow direction of the fluid.

19. The heat exchanger according to claim 18, wherein the first fin unit comprises a third louver obliquely extending downwardly from the first top portion, and the first louver and the third louver are symmetrical; the second fin unit comprises a fourth louver obliquely extending downwardly from the second top portion, and the second louver and the fourth louver are symmetrical; and the third louver and the fourth louver are staggered in the inflow direction of the fluid to form a second space between the third louver and the fourth louver.

* * * * *